US012448753B2

(12) United States Patent
DeWind et al.

(10) Patent No.: US 12,448,753 B2
(45) Date of Patent: Oct. 21, 2025

(54) OFFSET BOX APPARATUS FOR A TRENCHER

(71) Applicant: One Pass Innovators, LLC, Zeeland, MI (US)

(72) Inventors: Ryan DeWind, Zeeland, MI (US); Gregory Allen DeWind, Zeeland, MI (US)

(73) Assignee: One Pass Innovators, LLC, Zeeland, MI (US)

( * ) Notice: Subject to any disclaimer, the term of this patent is extended or adjusted under 35 U.S.C. 154(b) by 927 days.

(21) Appl. No.: 17/558,424

(22) Filed: Dec. 21, 2021

(65) Prior Publication Data

US 2022/0195694 A1 Jun. 23, 2022

Related U.S. Application Data

(60) Provisional application No. 63/128,580, filed on Dec. 21, 2020.

(51) Int. Cl.
*E02F 5/06* (2006.01)
*E02F 5/14* (2006.01)

(52) U.S. Cl.
CPC . *E02F 5/06* (2013.01); *E02F 5/14* (2013.01)

(58) Field of Classification Search
CPC ..... E02F 5/06; E02F 5/02; E02F 5/109; E02F 3/08; E02F 5/14; E02F 5/145; E02F 3/10; E02F 3/083; E02F 3/086; E02F 3/088; E02F 3/146
See application file for complete search history.

(56) References Cited

U.S. PATENT DOCUMENTS

| | | | | |
|---|---|---|---|---|
| 1,019,242 A * | 3/1912 | Frechette | E02F 3/08 | 37/354 |
| 6,658,768 B1 * | 12/2003 | Bainter | E02F 3/10 | 37/360 |
| 6,708,430 B2 * | 3/2004 | Azure | E02F 5/06 | 37/361 |
| 6,789,336 B2 * | 9/2004 | Collins | E02F 5/06 | 37/352 |
| 8,209,889 B2 * | 7/2012 | Lanser | E02F 3/146 | 37/355 |
| 8,966,790 B2 * | 3/2015 | van de Coterlet | E02F 3/10 | 37/352 |
| 10,246,852 B2 * | 4/2019 | DeWind | E02F 3/088 | |

(Continued)

*Primary Examiner* — Christopher J Sebesta
*Assistant Examiner* — Blake E Scoville
(74) *Attorney, Agent, or Firm* — The Watson IP Group; Jovan N. Jovanovic

(57) ABSTRACT

An apparatus comprises an offset box housing, a rotating shaft, and an offset chain guide member. The offset box housing includes a top end, a bottom end, a first side, and a second side. The rotating shaft is disposed within the offset box housing, is proximate to the top end of the offset box housing, and includes a first end and a second end, the first end of the rotating shaft is proximate to the first side of the offset box housing. The second end is proximate to the second side of the offset box housing. The rotating shaft including a first sprocket coupled to the rotating shaft. The offset chain guide member guides a chain between the first sprocket and a second sprocket that is coupled to both the offset chain guide member and a trenching mechanism that is disposed offset with respect to a trencher.

13 Claims, 6 Drawing Sheets

(56) References Cited

U.S. PATENT DOCUMENTS

| | | | | |
|---|---|---|---|---|
| 2012/0227292 | A1* | 9/2012 | Trebil | E02F 5/06 37/352 |
| 2013/0192097 | A1* | 8/2013 | van de Coterlet | E02F 3/10 37/352 |
| 2018/0328001 | A1* | 11/2018 | DeWind | E02F 3/087 |

* cited by examiner

OFFSET BOX APPARATUS FOR A TRENCHER

CROSS-REFERENCE TO RELATED APPLICATION

This application claims priority from U.S. Provisional Patent Application Ser. No. 63/128,580 filed on Dec. 21, 2020, entitled "OFFSET BOX APPARATUS FOR A TRENCHER", the entire disclosure of which is hereby incorporated by reference in its entirety.

BACKGROUND OF THE DISCLOSURE

1. Field of the Disclosure

The disclosure relates in general to an offset box, and more particularly, to an offset box apparatus for a trencher.

2. Background Art

In-ground systems are used for a variety of purposes, such in-ground systems include in-ground trenches and walls. These in-ground systems can include ground fluid and product recovery trenches, seepage trenches/collection trenches, slurry walls and cement walls, permeable reactive barriers/full and gate systems, High Density Poly Ethylene (HDPE) barrier walls, underground alluvial fluid storage reservoir containment walls, cement footing foundations and "formless walls", etc. Large scale industrial trenchers have been developed that are able to dig trenches that are extremely deep (e.g., up to 125' feet below grade), these trenches being used to form such in-ground trenches and walls. For example, this trencher can be of the type developed by DeWind Corporation. The trencher can be of the type that uses one-pass trenching technology, such as model MT2000 or MT3500. These trenchers install various types of systems deeper, faster, safer, and at less cost than most conventional alternatives. The MT 3500 (e.g., with up to 3,500 horse power) can reach depths of up to 125' feet below grade for "Mix In Place" walls, such as soil Bentonite Walls, and soil cement Bentonite wall installations.

These one-pass trenchers can mixed-in-place soil Bentonite and soil, cement Bentonite into a completely homogenized wall from top to bottom and from start to finish. These one-pass trenchers utilize a continuous vertical mixing that eliminates possibility for a window or void in the wall. One-pass barrier walls are evenly and consistently mixed throughout. These one-pass trenchers can mix a heavy high slump mix in-place. This ability to mix a super heavy slump makes one-pass ideal for dam and levee repair.

SUMMARY OF THE DISCLOSURE

The disclosure is directed to an apparatus comprising an offset box housing, a rotating shaft, and an offset chain guide member. The offset box housing includes a top end, a bottom end, a first side, and a second side. The rotating shaft is disposed within the offset box housing and is proximate to the top end of the offset box housing. The rotating shaft includes a first end and a second end, the first end of the rotating shaft is proximate to the first side of the offset box housing. The second end is proximate to the second side of the offset box housing. The rotating shaft including a first sprocket coupled to the rotating shaft. The offset chain guide member extends from the bottom end of the offset box housing to guide a chain between the first sprocket and a second sprocket. The second sprocket is coupled to both the offset chain guide member and a trenching mechanism that is disposed offset with respect to a trencher.

In some configurations, a system includes the apparatus, the system further comprising a transmission to transfer power received from an engine to the rotating shaft.

In some configurations, the chain is a first chain, the transmission includes a third sprocket and a fourth sprocket, with a second chain coupling the third sprocket to the fourth sprocket of the transmission.

In some configurations, the third sprocket is coupled to a drive shaft that is disposed alongside the offset box housing.

In some configurations, the drive shaft is disposed on a same side of the offset box housing as an apparatus mount to mount the apparatus to a support arm of the trencher including an engine to power the rotating shaft.

In some configurations, the offset box housing further includes a metering mount to mount a metering apparatus onto the offset box housing, the metering apparatus metering a desired quantity powder into a trench formed by the trenching mechanism.

In some configurations, the chain is a first chain and the trenching mechanism includes a plurality of ground digging plates to dig the trench in the ground, the system further comprising a second chain to drive the plurality of ground digging plates.

In some configurations, the ground digging plates each include hardened teeth along a length of each of the ground digging plates.

In some configurations, the ground digging plates vary in size according to a desired width of a trench formed by the ground digging plates.

In some configurations, the apparatus further includes a fluid hose coupler disposed along an outside surface of the offset box housing, the fluid hose coupler coupled to a fluid hose that directs fluid into the offset box housing.

In some configurations, the apparatus further comprises an apparatus mount disposed on an outside surface of the offset box housing, the apparatus mount to mount the apparatus to a support arm of the trencher including an engine to power the rotating shaft.

In some configurations, the first pair of couplers are coupled to a hydraulic piston coupled to a main body of the trencher and the second pair of couplers are coupled to a pair of hinges coupled to the support arm, the hydraulic piston pushing and pulling on the offset box housing to change an angle of the apparatus relative to a ground.

BRIEF DESCRIPTION OF THE DRAWINGS

The disclosure will now be described with reference to the drawings wherein.

DETAILED DESCRIPTION OF THE DISCLOSURE

Figure 1:
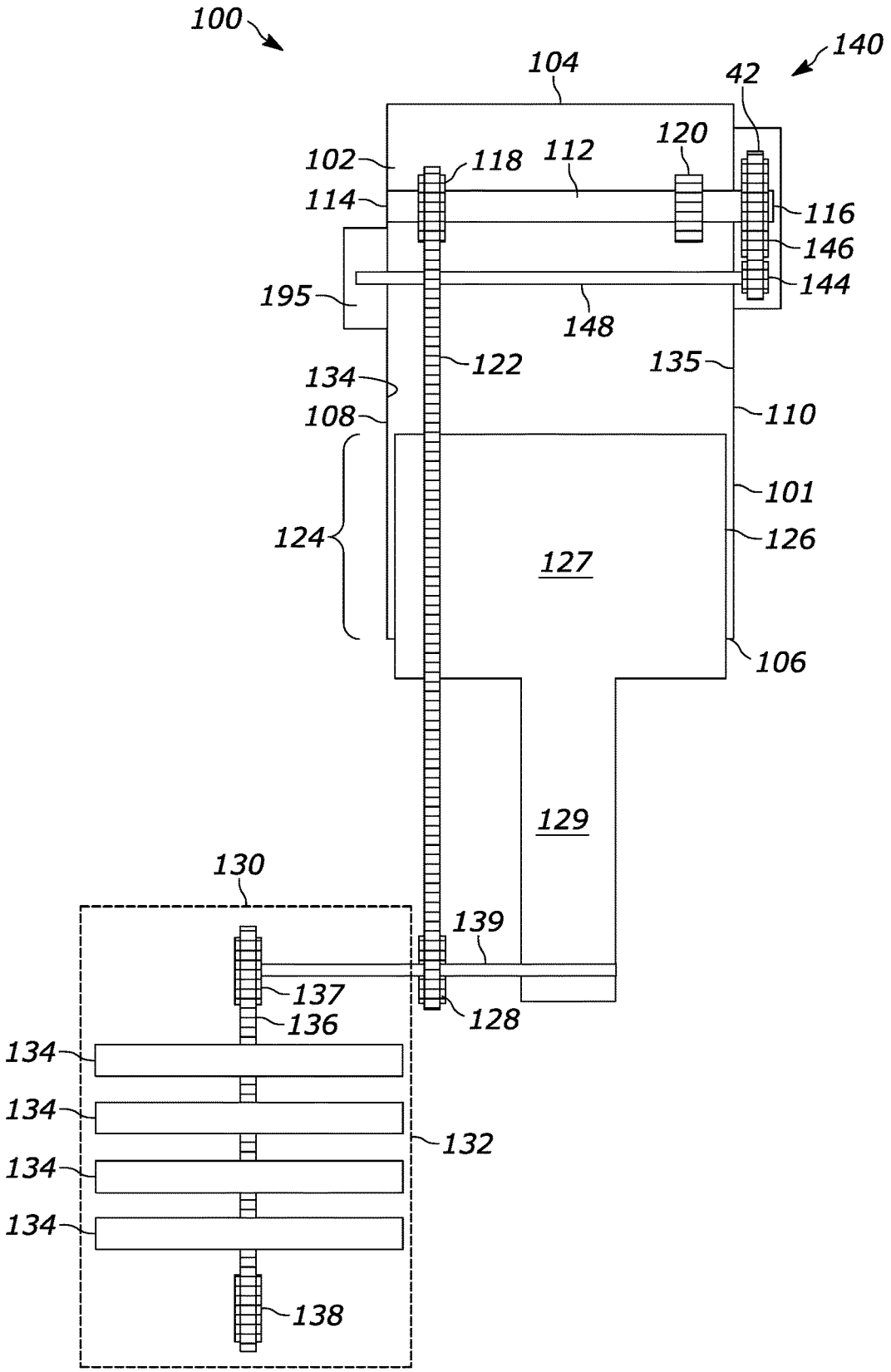
FIG. 1 illustrates a cutaway view of an example offset box for use with a trencher, in accordance with one or more embodiments.

While this disclosure is susceptible of embodiment(s) in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1-6, an apparatus, such as an offset box 100 utilized with a trencher 175 (FIGS. 2-4) is shown. The offset box 100 includes an offset box housing 102 that includes a top end 104, a bottom end 106, a first side 108, and a second side 110. In accordance with the example shown, the offset box housing 102 is rectangular in shape, being longer in height than in width. However, in other embodiments the offset box housing 102 can be other shapes (e.g., square, tapering, etc.) and/or smaller in height than in width. The offset box housing 102 can be formed from steel, aluminum, alloys of steel and/or aluminum, or any other material that provides the strength needed to support a rotating shaft 112 and a trenching mechanism 130, disclosed herein.

The offset box 100 further includes the rotating shaft 112. This rotating shaft 112 is disposed within the offset box housing 102 and is proximate to the top end 104 of the offset box housing 102. The rotating shaft 112 includes a first end 114 and a second end 116. The first end 114 of the rotating shaft 112 is proximate to the first side 108 of the offset box housing 102. In at least one embodiment, the first end 114 of the rotating shaft 112 protrudes through the first side 108 of the offset box housing 102 and is coupled to a drive member 195 of the trencher 175. The second end 116 of the rotating shaft 112 is proximate to the second side 110 of the offset box housing 102. In at least one embodiment, the second end 116 of the rotating shaft 112 protrudes through the second side 110 of the offset box housing 102. The offset box 100 can include bearings (not shown) disposed at locations where the rotating shaft 112 protrudes from and is supported by the offset box housing 102.

The rotating shaft 112 includes a first sprocket 118 coupled to the rotating shaft 112. The first sprocket 118 can be fastened to the rotating shaft 112 such that these two components turn in unison when power is applied to the rotating shaft 112. In the example shown, the first sprocket 118 is shown as being disposed proximate to the first side 108 of the offset box housing 102. In other examples, the first sprocket 118 can be disposed proximate to the second side 110 of the offset box housing 102. In yet other embodiments, the first sprocket 118 can be disposed approximately centered between the first side 108 and the second side 110. As shown in FIG. 1, another sprocket 120 can be coupled to the rotating shaft 112 in the event that a configuration of the offset box 100 is needed in which a chain 122 (FIG. 1) shown as being coupled to the first sprocket 118 needs to be moved to an opposite side of the offset box housing 102, proximate to the second side 110 of the offset box housing 102.

The offset box 100 further includes a guide member receiver 124 that is disposed proximate to the bottom end 106 of the offset box housing 102. The guide member receiver 124 receives an offset chain guide member 126 that extends from the bottom end 106 of the offset box housing 102. In the example shown, the offset chain guide member 126 is approximately (as much as −2%) a same width as an inside width of the offset box housing 102, not shown to scale. This tight tolerance prevents the offset chain guide member 126 from significantly moving while the trenching mechanism 130 is turning. The offset chain guide member 126 tapers from a wider portion 127 that is disposed within the offset box housing 102 to a narrowed portion 129 of offset chain guide member 126 that is disposed below the offset box housing 102. The offset chain guide member 126 guides the chain 122 between the first sprocket 118 coupled to the rotating shaft 112 and a second sprocket 128. This second sprocket 128 is coupled to the offset chain guide member 126 and the trenching mechanism 130 that is used to dig a trench in a ground.

The trenching mechanism 130 extends from the offset chain guide member 126 such that the trenching mechanism 130 is offset with respect to the offset box housing 102. For example, one side of the trenching mechanism 130, right side 132, can approximately align (+−12 inches) with the first side 108 of the offset box housing 102, to dispose the trenching mechanism 130 outboard of the trencher 175. As shown, the trenching mechanism 130 extends outboard of the trencher 175 to allow the trencher 175 to form the trench 180 extremely near (e.g., within inches) of a boundary 182 (FIG. 4) (e.g., a wall, a border, a property line, etc.), while the trencher 175 remains offset with respect to the trench 180 during formation of the trench 180. With this configuration, the trencher 175 can form the trench 180 without the trencher 175 crossing into a restricted area, such as the boundary 182. This in contrast with a typical trencher that forms a trench that passes underneath this typical trencher.

Figure 2:
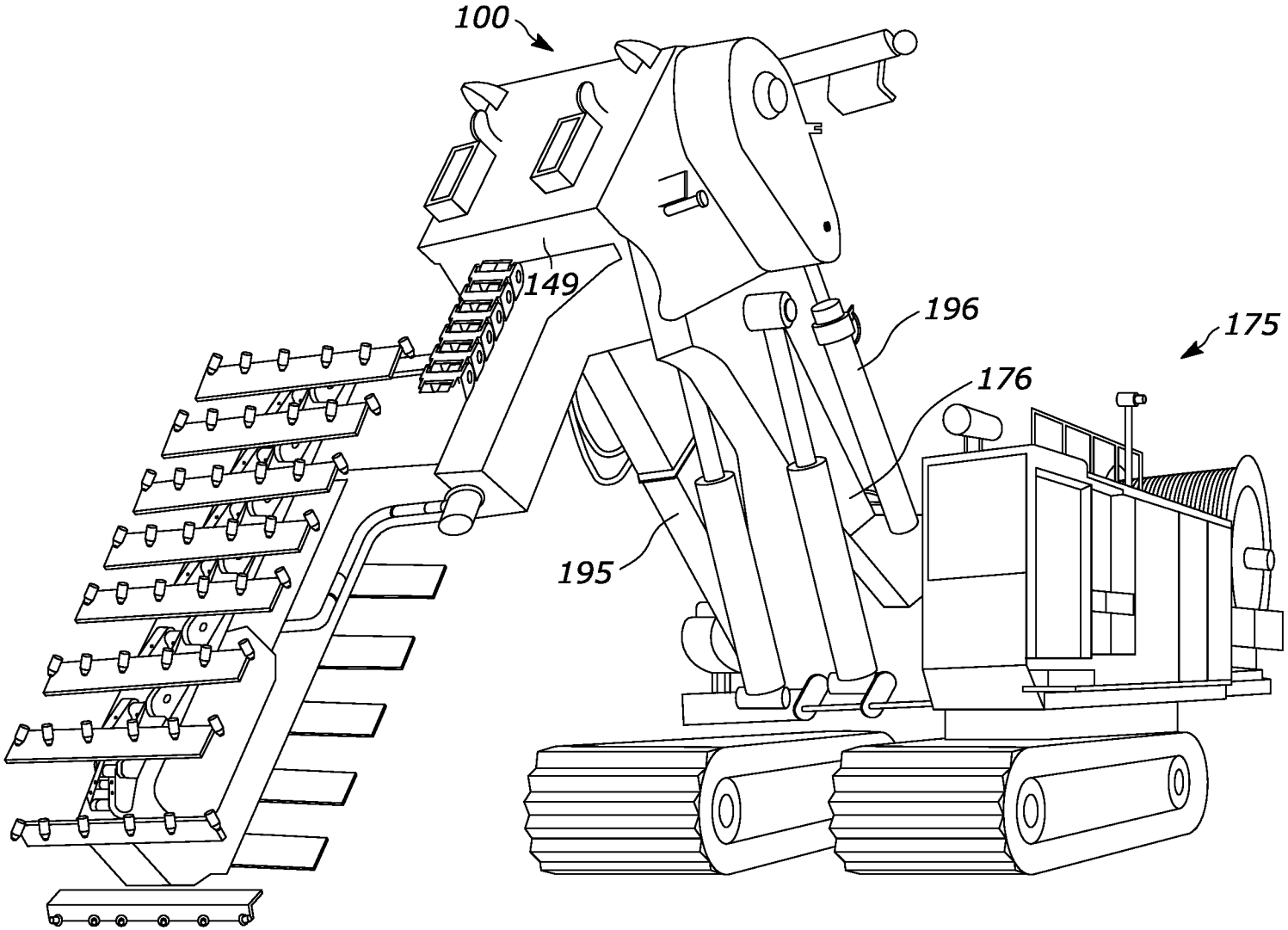
FIG. 2 illustrates the offset box coupled to the trencher, the offset box being positioned prior to forming a trench, in accordance with one or more embodiments.
Figure 3:
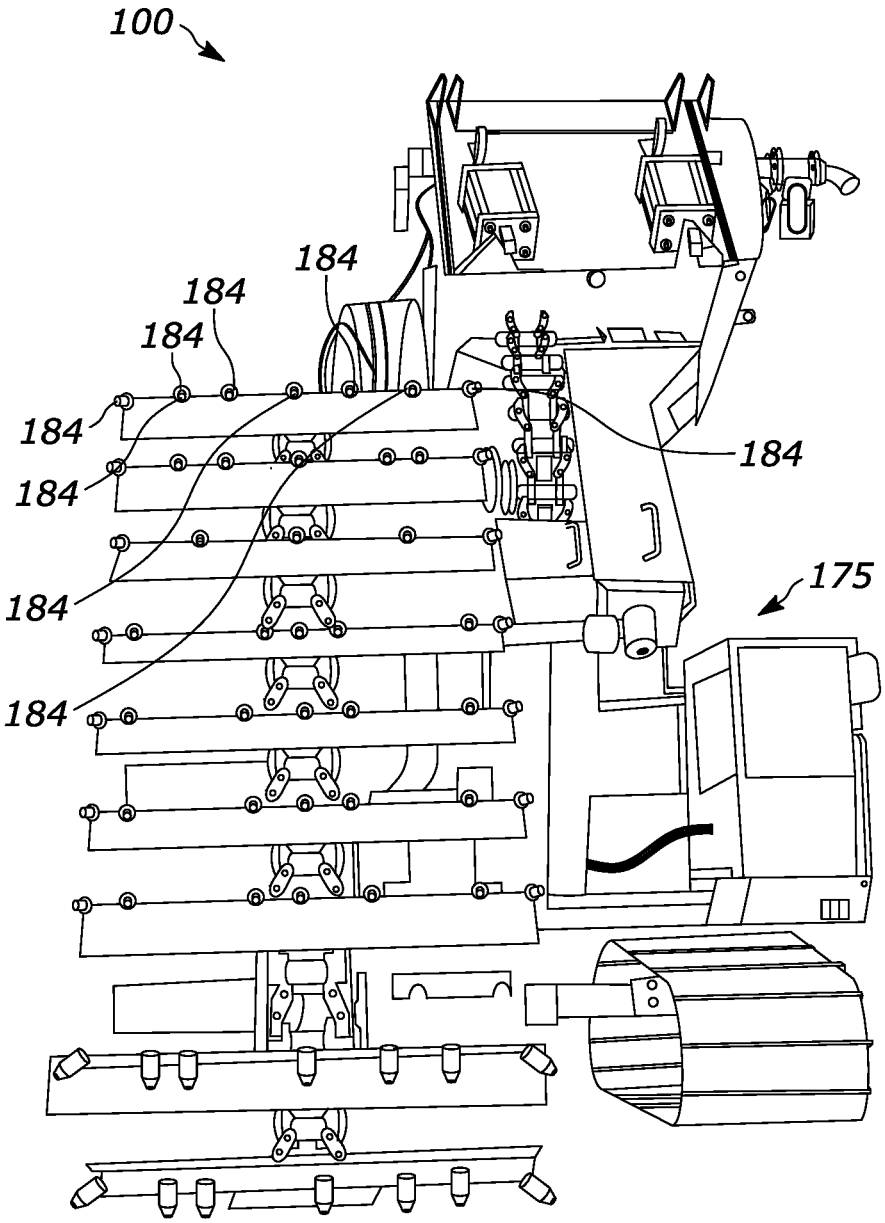
FIG. 3 illustrates another angle view of the offset box coupled to the trencher shown in FIG. 3, in accordance with one or more embodiments.
Figure 4:
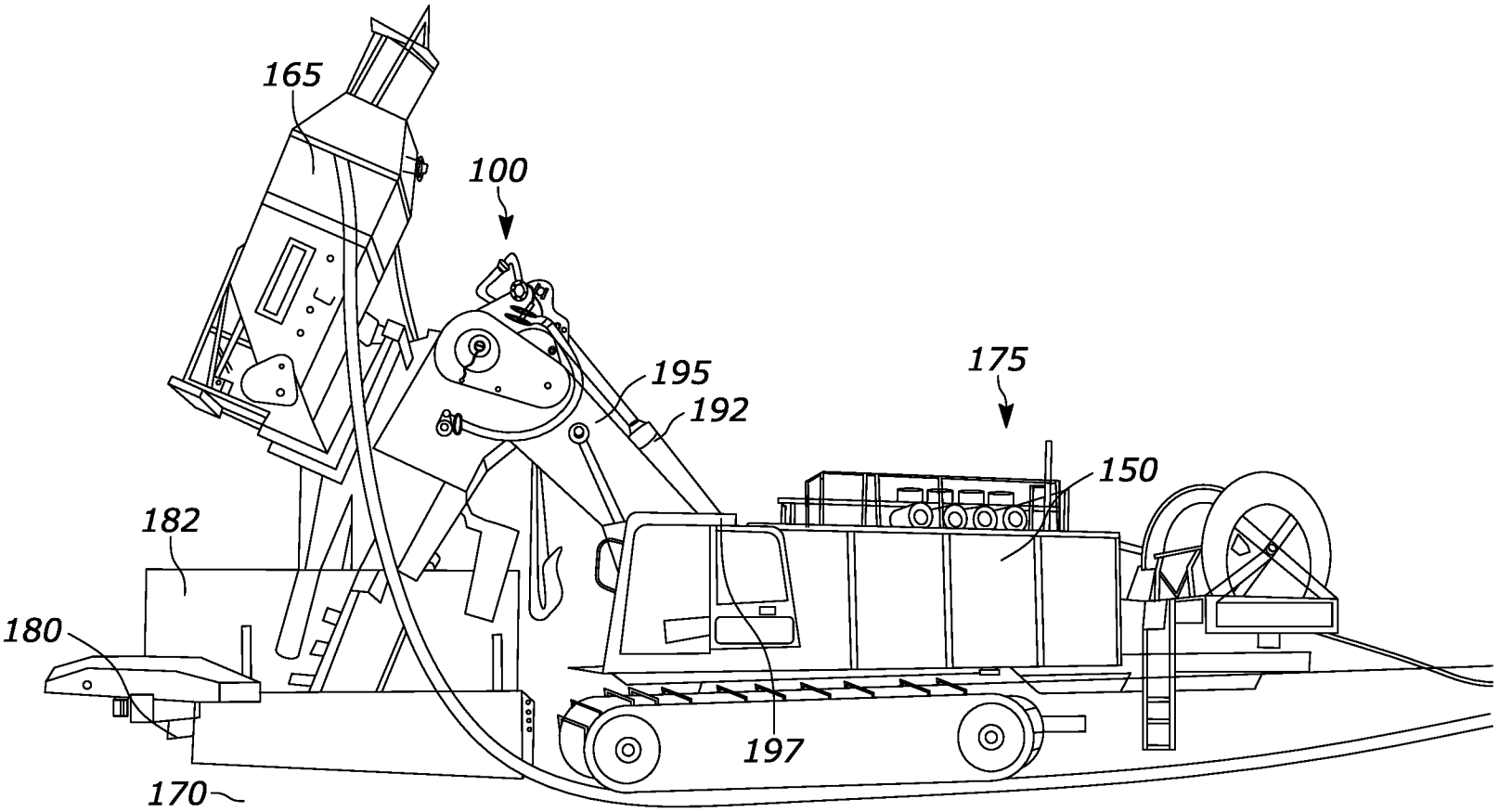
FIG. 4 illustrates the offset box coupled to the trencher as the trenching is beginning to enter a ground to form the trench, in accordance with one or more embodiments.

In at least one embodiment, the guide member receiver 124 can include guide members (not shown) that assist in minimizing movement of the offset chain guide member 126 when disposed within the offset box housing 102. For example, these guide members can be disposed on inside surfaces 134/135 of the first side 108 and the second side 110, respectively, to maintain a space 149 between the offset chain guide member 126 and the offset box housing 102, as shown in FIG. 2. This space 149 prevents the offset chain guide member 126 from pushing the chain 122 into the offset box housing 102.

In at least one embodiment, a transmission 140 can be coupled to the offset box 100. The transmission 140 transfers power received from an engine 150 of the trencher 175 to the rotating shaft 112. In at least one embodiment, the transmission 140 includes a third sprocket 142 coupled to the rotating shaft 112 and a fourth sprocket 144. Another chain, such as chain 146, couples the third sprocket 142 to the fourth sprocket 144. When a rotating force is applied to the fourth sprocket 144 such a rotation force is transferred from the fourth sprocket to the third sprocket 142, via this another chain 146 of the transmission 140.

Figure 5:
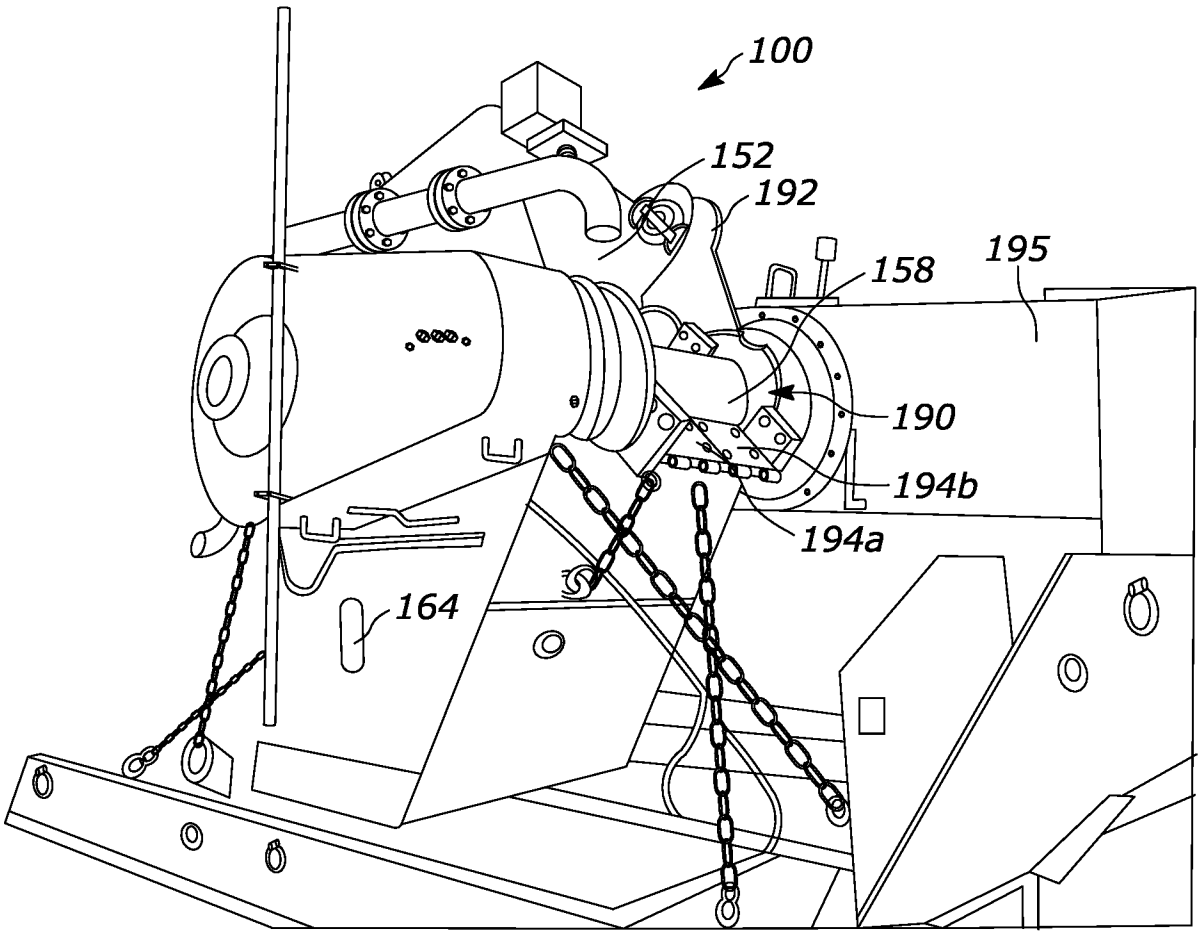
FIG. 5 illustrates a rear isometric view of the offset box prior to attachment of the offset box to a support arm of the trencher, in accordance with one or more embodiments.
Figure 6:
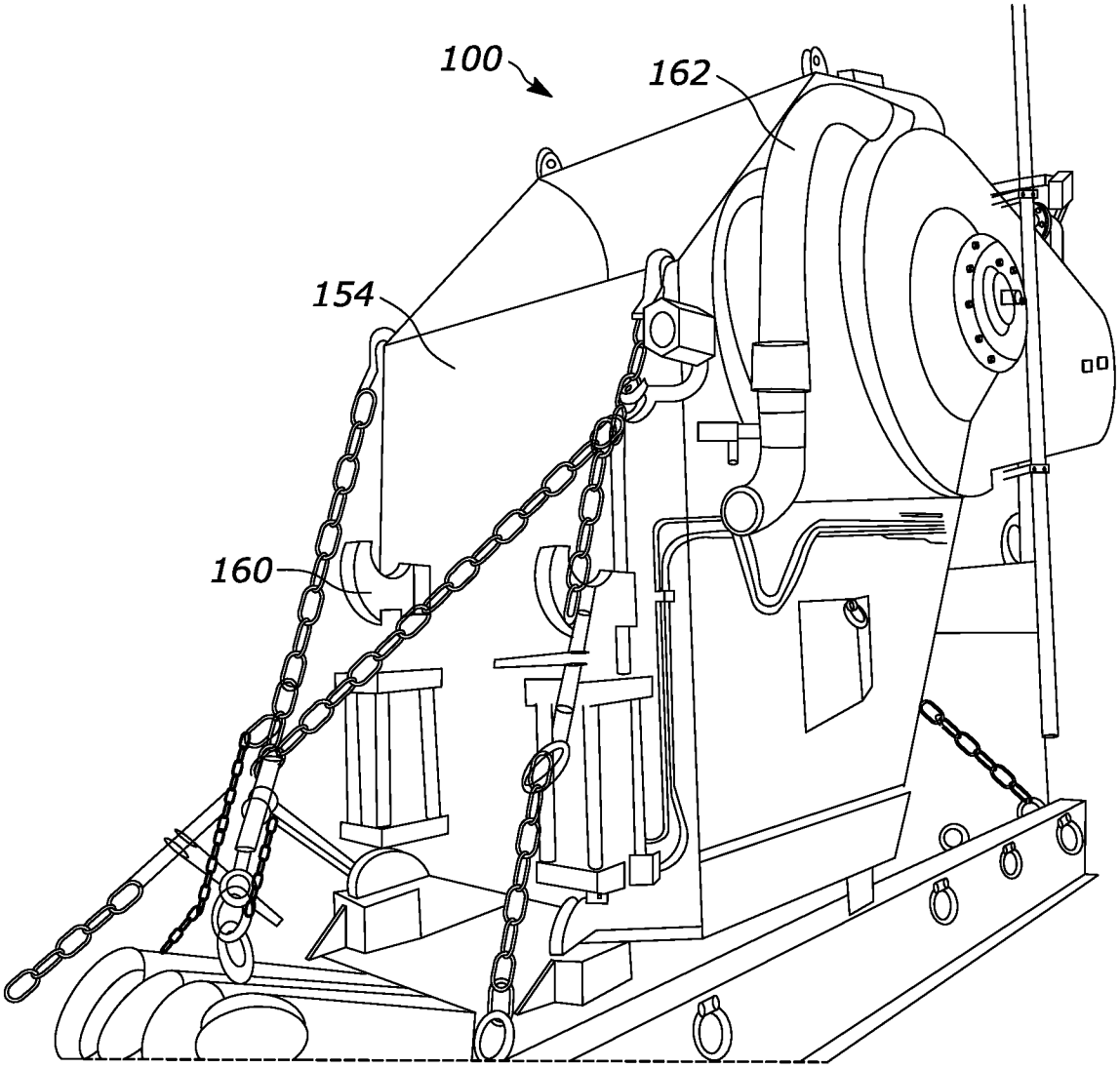
FIG. 6 illustrates a front isometric view of the offset box prior to attachment of the offset box to the support arm of the trencher, in accordance with one or more embodiments.

In at least one embodiment, this fourth sprocket 144 is coupled to a drive shaft 148. In at least one embodiment, the drive shaft 148 is disposed alongside the offset box housing 102, as shown in FIG. 5. In at least one embodiment, the drive shaft 148 is disposed on a same side, back side 152

(FIG. 5) of the offset box housing 102 to which a housing mount 158 (FIG. 5) is disposed to mount the offset box 100 to a support arm 176 of the trencher 175, that includes an engine 150 to power the rotating shaft 112. In other embodiments, the drive shaft 148 can be disposed on an opposite side of the offset box housing 102 than that shown, on a front side of the offset box housing 102.

In at least one embodiment, the offset box housing 102 further includes a metering mount 160 on a front side 154 to mount a metering apparatus 165 onto the offset box housing 102. For example, the metering apparatus 165 can be of the type that meters out a desired quantity of bulk material (not shown) into the trench 180 formed by the trenching mechanism 130.

In at least one embodiment, the bulk material can be comprised of concrete and/or Bentonite which is an absorbent aluminum phyllosilicate clay consisting mostly of montmorillonite. It was named by Wilbur C. Knight in 1898 after the Cretaceous Benton Shale near Rock River, Wyoming. The different types of Bentonite are each named after the respective dominant element, such as potassium (K), sodium (Na), calcium (Ca), and aluminum (Al). Bentonite usually forms from weathering of volcanic ash, most often in the presence of fluid. However, the term Bentonite, as well as a similar clay called tonstein, has been used to describe clay beds of uncertain origin. For industrial purposes, two main classes of Bentonite exist: sodium and calcium Bentonite. In stratigraphy and tephrochronology, completely devitrified (weathered volcanic glass) ash-fall beds are commonly referred to as K-Bentonites when the dominant clay species is illite. In addition to montmorillonite and illite, another common clay species that is sometimes dominant is kaolinite. Kaolinite-dominated clays are commonly referred to as tonsteins and are typically associated with coal.

The property of swelling on contact with fluid makes sodium Bentonite useful as a sealant, since it provides a self-sealing, low-permeability barrier. It is used to line the base of landfills to prevent migration of leachate, for quarantining metal pollutants of ground fluid, and for the sealing of subsurface disposal systems for spent nuclear fuel.[10] Similar uses include making slurry walls, fluid proofing of below-grade walls, and forming other impermeable barriers, e.g., to seal off the annulus of a fluid well, to plug old wells.

Bentonite can also be "sandwiched" between synthetic materials to create geosynthetic clay liners (GCLs) for the aforementioned purposes. This technique allows for more convenient transport and installation, and it greatly reduces the volume of bentonite required. It is also used to form a barrier around newly planted trees to constrain root growth so as to prevent damage to nearby pipes, footpaths and other infrastructure. Farmers use bentonite to seal retention ponds and line canals.

In at least one embodiment, the trenching mechanism 130 includes a plurality of ground digging plates 134 to dig the trench 180 in a ground 170. The trenching mechanism 130 can include another chain 136 that is coupled to and drives the plurality of ground digging plates 134. In other embodiments, the trenching mechanism 130 can use a belt, such as a toothed belt, to drive the plurality of ground digging plates 134. In still other embodiments, the trenching mechanism 130 can use gears to drive the plurality of ground digging plates 134. In at least one embodiment, the plurality of ground digging plates 134 each include hardened teeth 184 (e.g., carbide tipped, diamond tipped, etc.) along a length of each of the plurality of ground digging plates 134. In the embodiment shown, the plurality of ground digging plates 134 each include seven (7) such hardened teeth 184. In other embodiments, the plurality of ground digging plates 134 can use more or less hardened teeth 184.

In at least one embodiment, the plurality of ground digging plates 134 can vary in size according to a desired width of the trench 180 formed by the plurality of ground digging plates 134. For example, the plurality of ground digging plates 134 can be made 3 feet in width to dig the trench 180 that is approximately 3 feet in width. Alternatively, the plurality of ground digging plates 134 can be made 6 feet in width to dig the trench 180 that is approximately 6 feet in width. Thus, the plurality of ground digging plates 134 can be made any width to correspond to a desired trench width. The trenching mechanism 130 can further include sprockets 137/138 about which chain 136 traverses, sprocket 136 being disposed proximate to sprocket 128 and sprocket 138 being disposed on an opposite end of the trenching mechanism 130 relative to sprocket 137. Sprockets 137/128 are coupled to a common shaft 139.

In at least one embodiment, the offset box 100 further includes a fluid hose coupler 186 disposed along an outside surface 101 of the offset box housing 102. In the example shown in FIG. 6, the fluid hose coupler 186 is disposed proximate to the transmission 140, although in other embodiments the fluid hose coupler 186 can be disposed wherever is convenient for operation of the offset box 100. In the example shown in FIG. 6, the fluid hose coupler 186 is coupled to a fluid hose 162 that directs fluid (e.g., water) into the offset box housing 102. For example, the offset box housing 102 includes an opening 164 (FIG. 5) disposed through the offset box housing 102 into which the fluid hose 162 directs the fluid into the offset box housing 102. In the example shown, the opening 164 is disposed below the transmission 140, through the outside surface 101. This fluid is carried by the trenching mechanism 130 into the trench 180 as the trenching mechanism 130 digs the trench 180.

In at least one embodiment, the offset box 100 further includes an offset box mount 190 that is disposed on the outside surface 101 of the offset box housing 102. The offset box mount 190 mounts the offset box 100 to a support arm 176 of the trencher that includes the engine 150 to power the rotating shaft 112. In at least one embodiment, the offset box mount 190 includes a first coupler 192 disposed proximate to the top end 104 of the offset box housing 102 and a pair of couplers 194*a*/194*b* disposed between the first coupler 192 and the bottom end 106 of the offset box housing 102. In at least one embodiment, the first coupler 192 is coupled to a hydraulic piston 196 coupled to a main body 197 of the trencher 175. The second pair of couplers 194*a*/194*b* are coupled to the support arm 176. The hydraulic piston 196 pushes and pulls on the offset box housing 102 to change an angle of the offset box 100 relative to the ground 170. For example, the hydraulic piston 196 is shown in FIG. 2 as having pulled the offset box 100 at an angle at which the trenching mechanism 130 is non-vertical, that is either entering the ground 170 or being removed from the ground 170.

The offset box 100 can be of the type that is used with the trencher 175, such as that developed by DeWind Corporation. The trencher 175 can be of the type that uses one-pass trenching technology, such as model MT2000 or MT3500. These trenchers install various types of systems deeper, faster, safer, and at less cost than most conventional alternatives. The MT 3500 (e.g., with up to 3,500 horse power) can reach depths of up to 125' feet below grade for "Mix In Place" walls, such as soil Bentonite Walls, and soil cement Bentonite wall installations. These one-pass trenchers can mixed-in-place soil Bentonite and soil, cement Bentonite into a completely homogenized wall from top to bottom and from start to finish. These one-pass trenchers utilize a continuous vertical mixing that eliminates possibility for window or voids in the wall. One-pass barrier walls are evenly and consistently mixed throughout. These one-pass trenchers can mix a heavy high slump mix in place. This ability to mix a super heavy slump makes one-pass ideal for dam and levee repair. The double auger apparatus 100 can be used as a metered Bentonite delivery system.

These one-pass trenchers can use underground fluid injection nozzles, pre-mixed slurry injection ports, speed controls for both the mixing chain and track speeds, GPS mapping and laser guides to control depth. Engineers who use these one-pass trenchers prefer them to conventional excavator installation methods because of the completely homogenized soils from top to bottom, secure key into confining layer, no possibility for voids in the wall, precise laser installations, no messing mixing ponds, ability to work in tight sites, no open excavation and fast installation rates with a precise mapping of the alignment for future use. These one-pass trenchers can build trenches that are 125'+ deep, are typically 12"-48" wide, or even wider, and can build 200-500 linear feet per day.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. An apparatus, comprising:

an offset box housing including a top end, a bottom end, a first side, and a second side;

a rotating shaft, disposed within the offset box housing and proximate to the top end of the offset box housing, the rotating shaft extending from a first end to a second end, the first end of the rotating shaft positioned proximate to the first side of the offset box housing, the second end positioned proximate to the second side of the offset box housing, and the rotating shaft including a first sprocket coupled to the rotating shaft such that the sprocket will rotate as the rotating shaft rotates;

a transmission configured to transfer power received from an engine to the rotating shaft, the transmission having a first and second transmission sprocket, with a transmission chain coupling the first and second transmission sprockets;

an offset chain guide member that extends from a first end to a second end, the first end coupled to the bottom end of the offset box housing and the second end extended a distance therefrom;

a second sprocket coupled to the second end of the offset chain guide member, the first and second sprockets configured to rotate in unison when connected by a chain; and the second sprocket being rotatably coupled to the offset chain guide member and configured to actuate a trenching mechanism that is disposed offset with respect to the offset box housing.

2. The apparatus according to claim 1, wherein the first transmission sprocket is coupled to a drive shaft that is disposed alongside the offset box housing.

3. The apparatus according to claim 2, wherein the drive shaft is disposed on a same side of the offset box housing as an apparatus mount to mount the apparatus to a support arm of a trencher including an engine to power the rotating shaft.

4. The apparatus according to claim 1, wherein the offset box housing further includes a metering mount to mount a metering apparatus onto the offset box housing, the metering apparatus metering a desired quantity powder into a trench formed by the trenching mechanism.

5. The apparatus according to claim 1, wherein the chain is a first chain and the trenching mechanism includes a plurality of ground digging plates to dig the trench in the ground, the apparatus further comprising a second chain to drive the plurality of ground digging plates.

6. The apparatus according to claim 5, wherein the ground digging plates each include hardened teeth along a length of each of the ground digging plates.

7. The apparatus according to claim 5, wherein the ground digging plates vary in size according to a desired width of a trench formed by the ground digging plates.

8. The apparatus according to claim 1, wherein the apparatus further includes a fluid hose coupler disposed along an outside surface of the offset box housing, the fluid hose coupler coupled to a fluid hose that directs fluid into the offset box housing.

9. The apparatus according to claim 1, further comprising an apparatus mount disposed on an outside surface of the offset box housing, the apparatus mount to mount the apparatus to a support arm of a trencher including an engine to power the rotating shaft.

10. The apparatus according to claim 9, wherein the apparatus mount includes a first coupler disposed proximate to the top end of the offset box housing and a second pair of couplers disposed between the first coupler and the bottom end of the offset box housing.

11. The apparatus according to claim 10, wherein the first coupler is coupled to a hydraulic piston coupled to a main body of the trencher and the second pair of couplers are coupled to a pair of hinges coupled to the support arm, the hydraulic piston configured to push and pull on the offset box housing to change an angle of the apparatus relative to a ground.

12. The apparatus according to claim 1, wherein the guide member tapers in cross-sectional area from the first end to the second end.

13. The apparatus according to claim 1, wherein the second sprocket is coupled to the chain guide member by use of a second rotating shaft extending laterally from the chain guide member, the second rotating shaft configured to rotate in unison with the first and second sprockets, and the second rotating shaft utilized to drive a trencher.

* * * * *